US006997263B2

(12) United States Patent
Campbell et al.

(10) Patent No.: US 6,997,263 B2
(45) Date of Patent: Feb. 14, 2006

(54) MULTI ZONE ISOLATION TOOL HAVING FLUID LOSS PREVENTION CAPABILITY AND METHOD FOR USE OF SAME

(75) Inventors: Patrick F. Campbell, Dallas, TX (US); William David Henderson, Tioga, TX (US); Jay B. Shivers, Liberty, TX (US); Mark E. P. Dawson, Metarie, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 210 days.

(21) Appl. No.: 10/427,053

(22) Filed: Apr. 30, 2003

(65) Prior Publication Data

US 2004/0020652 A1 Feb. 5, 2004

Related U.S. Application Data

(63) Continuation-in-part of application No. 09/932,188, filed on Aug. 17, 2001, now Pat. No. 6,634,429.

(60) Provisional application No. 60/229,230, filed on Aug. 31, 2000.

(51) Int. Cl.
*E21B 34/10* (2006.01)
*E21B 43/04* (2006.01)

(52) U.S. Cl. ..... 166/374; 166/51; 166/238; 166/321; 166/386

(58) Field of Classification Search ..... 166/278, 166/369, 370, 373, 374, 381, 386, 53, 51, 166/316, 319, 320, 321, 325, 326, 332.1, 166/237, 238
See application file for complete search history.

(56) References Cited

U.S. PATENT DOCUMENTS 4,105,069 A * 8/1978 Baker ..... 166/51
4,270,608 A * 6/1981 Hendrickson et al. ..... 166/278
4,627,488 A * 12/1986 Szarka ..... 166/51
5,343,949 A 9/1994 Ross et al.
5,392,850 A * 2/1995 Cornette et al. ..... 166/51
5,564,502 A * 10/1996 Crow et al. ..... 166/386
5,609,204 A 3/1997 Rebardi et al.
5,775,421 A 7/1998 Duhon et al.
5,803,177 A * 9/1998 Hriscu et al. ..... 166/305.1
5,865,251 A * 2/1999 Rebardi et al. ..... 166/278
5,909,769 A 6/1999 Duhon et al.
5,921,318 A * 7/1999 Ross ..... 166/250.17
6,227,298 B1 * 5/2001 Patel ..... 166/321
6,302,216 B1 * 10/2001 Patel ..... 166/375
6,516,886 B1 * 2/2003 Patel ..... 166/313
6,634,429 B1 * 10/2003 Henderson et al. ..... 166/332.1
6,722,440 B1 * 4/2004 Turner et al. ..... 166/374
2001/0030049 A1 * 10/2001 Patel ..... 166/386
2003/0019634 A1 1/2003 Henderson et al.
2003/0159832 A1 * 8/2003 Williamson ..... 166/375
2003/0221839 A1 * 12/2003 Turner et al. ..... 166/374
2004/0045709 A1 * 3/2004 Zuklic et al. ..... 166/278

* cited by examiner

*Primary Examiner*—Jennifer H. Gay
(74) *Attorney, Agent, or Firm*—Lawrence R. Youst

(57) ABSTRACT

A multi zone isolation tool (50) for use in a subterranean wellbore includes a first tubular and a second tubular disposed within the first tubular forming an annular flow path (110*a*, 110*b*) therebetween and a central flow path (70*a*, 80*a*, 80*b*) through the second tubular. An annular valving assembly (90, 80) is positioned in the annular flow path (110*a*, 110*b*) and a central valving assembly (148, 186) is positioned in the central flow path (70*a*, 80*a*, 80*b*). The central valving assembly (186) is operably coupled to the annular valving assembly (90) such that when the central valving assembly (148, 186) is in a closed position, a pressure variation in the central flow path (70*a*, 80*a*, 80*b*) will operate the annular valving assembly (90, 80) from a closed position to an open position.

43 Claims, 10 Drawing Sheets

MULTI ZONE ISOLATION TOOL HAVING FLUID LOSS PREVENTION CAPABILITY AND METHOD FOR USE OF SAME

CROSS-REFERENCE TO RELATED PATENT APPLICATIONS

This application is a continuation-in-part application of co-pending application Ser. No. 09/932,188 filed Aug. 17, 2001 entitled Upper Zone Isolation Tool for Smart Well Completions which claims priority from provisional application No. 60/229,230 filed Aug. 31, 2000, now U.S. Pat. No. 6,634,429 issued Oct. 21, 2003.

TECHNICAL FIELD OF THE INVENTION

This invention relates, in general, to improved methods and tools for completing, producing and servicing wells that traverse multiple hydrocarbon bearing subterranean zones and, in particular, to improved methods and tools for separately isolating, treating and producing multiple hydrocarbon bearing subterranean zones in a well.

BACKGROUND OF THE INVENTION

Without limiting the scope of the present invention, its background will be described with reference to treating multiple hydrocarbon bearing subterranean zones in a well, as an example.

It is common to encounter hydrocarbon wells that traverse more than one separate subterranean hydrocarbon bearing zone which may have similar or different characteristics. Production of hydrocarbons from these separate subterranean zones can be enhanced by performing various treatments. Examples of well treatments include fracturing, gravel packing, frac packing, chemical treatment and the like. The zone's particular characteristics determine the ideal treatments to be used. Accordingly, in multi zone wells, different well treatments may be required to properly treat the different zones.

For example, one or more of the zones may be an unconsolidated or poorly consolidated zone which may result in the production of sand along with the hydrocarbons if a sand control treatment is not performed. Specifically, it may be desirable to perform a gravel pack treatment in such an unconsolidated zone to control sand production from the well. The gravel pack treatment serves as a filter and helps to assure that fines and sand do not migrate with produced fluids into the wellbore.

In a typical gravel pack completion, a screen consisting of screen units is placed in the wellbore within the zone to be completed. The screen is typically connected to a tool having a packer and a crossover. The tool is in turn connected to a work or production string. A particulate material, usually graded sand (often referred to in the art as gravel) is pumped in a slurry down the work or production string and through the crossover whereby it flows into the annulus between the screen and the wellbore. Some of the liquid forming the slurry may leak off into the subterranean zone with the reminder passing through a screen sized to prevent the sand in the slurry from flowing therethrough. The transport fluid then returns to the annulus through the washpipe inside the screen that is connected to the workstring. As a result, the sand is deposited in the annulus around the screen whereby it forms a gravel pack. The size of the sand in the gravel pack is selected such that it prevents formation fines and sand from flowing into the wellbore with produced fluids.

As pointed out above, when a well intersects multiple spaced formation zones, each zone may require separate or even different successive treatments. In these multiple zone wells, a need arises to mechanically isolate the separate zones so that they may be individually treated. In the selected gravel packing treatment example, a multiple zone well may require that each zone be isolated and connected to the surface and treated individually. For example, undesirable fluid losses and control problems could prevent simultaneous gravel packing of multiple zones. In addition, each zone may require unique treatment procedures and subsequent individual zone testing and treatment may be required.

Conventional methods of isolating individual zones for treatment utilize multi-trip processes of setting temporary packers. To overcome these time consuming and expensive conventional methods, one-time hydraulic operated sleeves have been used to provide access to a zone after it has first been treated. When the zone is to be opened, the tools' hydraulically operated sleeve valve is opened as the well pressure is raised to a preset level and then bled off. These tools are one-shot in that they are installed in the closed position and once opened cannot be later closed to again isolate that particular zone. These prior systems and methods do not allow the zones to be selectively and repeatedly isolated for subsequent treatment and monitoring.

A need has therefore arisen for an apparatus that provides for the isolation of separate zones traversed by a wellbore such that individualized treatment processes may be performed on the separate zones. A need has also arisen for such an apparatus that can prevent fluid loss from one zone to the next during such individualized treatment processes. Further, a need has arisen for such an apparatus that can be reopened after the individualized treatment processes have been completed to allow for final completion and production from the multiple zones.

SUMMARY OF THE INVENTION

The present invention disclosed herein comprises tools and methods that provide for the isolation of separate zones traversed by a wellbore such that individualized treatment processes may be performed on the separate zones. The tools and methods of the present invention can prevent fluid loss from one zone to the next during such individualized treatment processes. In addition, the tools of the present invention can be reopened after the individualized treatment processes have been completed to allow for final completion and production from the multiple zones.

The multi zone isolation tool of the present invention is deployed downhole in a tool string that may include sand control screen assemblies, packers, a cross over tool and the like. The multi zone isolation tool comprises a first tubular and a second tubular that is disposed within the first tubular. An annular flow path is formed between the first and second tubulars that is in fluid communication with a first subterranean zone. A central flow path is defined within the second tubular that is in fluid communication with a second subterranean zone. An annular valving assembly including an annular valve and annular seat is mounted in the annular flow path to control fluid flow therethrough. A central valving assembly including a central valve and central seat is mounted in the central flow path to control fluid flow therethrough.

The annular valve is axially movable relative to the annular seat between a closed position and an open position. In the closed position, the annular valve is adjacent to the annular seat. In the open position, the annular valve is axially displaced from the annular seat. In one embodiment, the annular seat is slidably received within the annular valve.

The central valve is axially movable in a first direction relative to the central seat from an open position to a closed position. In the open position, the central valve is axially displaced from the central seat. In the closed position, the central valve is positioned within the central seat. The central valve is further axially movable in the first direction relative to the central seat from the closed position to a reopen position wherein the central valve passes through the central seat. In one embodiment, the central valve is a detachable plug. In another embodiment, the central seat is a collet seat having a retracted configuration wherein the central valve can pass through the central seat and a compressed configuration wherein the central valve can be sealingly received in the central seat.

The central seat is operably coupled to the annular valve such that when the central valve and central seat are in the closed position, a pressure variation in the central flow path acts on the central valve and central seat to operate the annular valve and annular seat from the closed position to the open position. In one embodiment, a sleeve operably couples the central seat to the annular valve. In this embodiment, the sleeve forms at least a portion of the second tubular. In addition, the sleeve is slidably received within the annular seat.

In one embodiment, a spring resiliently urging the annular valve toward the open position. In addition, a latch that is operably associated with the annular valve releasably maintains the annular valve in one of the open and closed positions. The latch may include a collet spring with lugs that engage recesses.

In one embodiment, the pressure variation used to operate the annular valve and annular seat from the closed position to the open position is an increase in the pressure in the central flow path to a first predetermined level. In this embodiment, raising the pressure in the central flow path to a second predetermined level that is higher than the first predetermined level may operate the central valve and central seat from the closed position to the reopen position.

In another aspect, the present invention involves a method for selectively controlling fluid flow between a wellbore and first and second zones. The method comprises disposing a multi zone isolation tool within the wellbore, positioning, in a closed position, an annular valve and annular seat in the annular flow path to control fluid flow therethrough, positioning, in an open position, a central valve and central seat in the central flow path to control fluid flow therethrough, operably coupling the central seat to the annular valve, accessing the first zone through the central flow path, operating the central valve and central seat from the open position to the closed position to prevent fluid loss to the first zone, varying the pressure in the central flow path to operate the annular valve and annular seat from the closed position to the open position, accessing the second zone through the annular flow path and operating the central valve and central seat from the closed position to a reopen position.

In another aspect, the present invention involves a method for producing hydrocarbons from a wellbore that traverses first and second zones. The method comprises disposing a multi zone isolation tool within the wellbore, positioning an annular valving assembly in the annular flow path to control fluid flow therethrough, positioning a central valving assembly in the central flow path to control fluid flow therethrough, operably coupling the central valving assembly to the annular valving assembly, operating the central valving assembly from an open position to a closed position, varying the pressure in the central flow path such that the central valving assembly operates the annular valving assembly from the closed position to the open position, operating the central valving assembly from the closed position to a reopen position and producing hydrocarbons from at least one of the first and second zones into the wellbore.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

The present invention provides improved methods and tools for completing and separately treating individual hydrocarbon zones in a single well. The methods can be performed in either vertical or horizontal wellbores. The term "vertical wellbore" is used herein to mean the portion of a wellbore in a producing zone to be completed which is substantially vertical, inclined or deviated. The term "horizontal wellbore" is used herein to mean the portion of a wellbore in a subterranean producing zone, which is substantially horizontal. Since the present invention is applicable in vertical, horizontal and inclined wellbores, the terms "upper and lower" and "top and bottom" as used herein are relative terms and are intended to apply to the respective positions within a particular wellbore while the term "levels" is meant to refer to respective spaced positions along the wellbore. The term "zone" is used herein to refer to separate parts of the well designated for treatment and includes an entire hydrocarbon formation or even separate portions of the same formation and horizontally and vertically spaced portions of the same formation. As used herein, "down," "downward" or "downhole" refer to the direction in or along the wellbore from the wellhead toward the producing zone regardless of whether the wellbore's orientation is horizontal, toward the surface or away from the surface. Accordingly, the upper zone would be the first zone encountered by the wellbore and the lower zone would be located further along the wellbore. Tubing, tubular, casing, pipe liner and conduit are interchangeable terms used herein to refer to walled fluid conductors.

Figure 1:
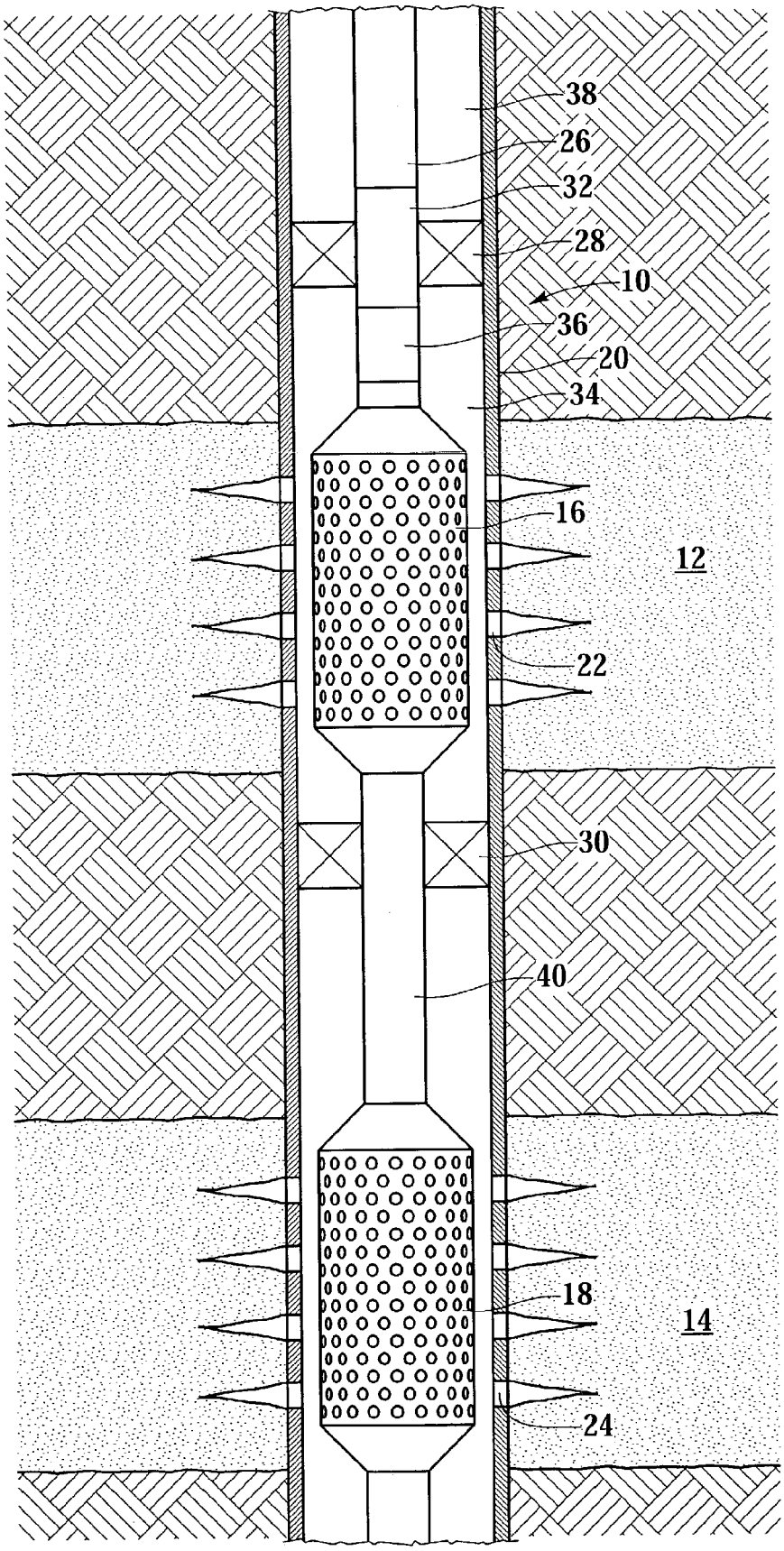
FIG. 1 is a schematic illustration of a completion system including a multi zone isolation tool of the present invention.

Referring initially to FIG. 1, a multi zone isolation tool of the present invention is disposed within a cased wellbore that is generally designated by reference numeral 10. Wellbore 10 is illustrated intersecting two separate hydrocarbon bearing zones, upper zone 12 and lower zone 14. For purposes of description only two zones are shown, but it is understood that the present invention has application to isolate any number of zones within a well. As mentioned, while wellbore 10 is illustrated as a vertical cased well with two producing zones, the present invention is applicable to horizontal and inclined wellbores with more than two treatment zones and in uncased wells. For purposes of explanation of the present invention, the formations are to be treated by gravel packing but as previously discussed the present invention has application in other types of well treatments.

Upper and lower sand screen assemblies 16, 18 are located inside casing 20 of wellbore 10 in the area of zones 12, 14, respectively. Casing 20 includes perforation 22, 24 to provide fluid flow paths into casing 20 from zones 12, 14, respectively. Production tubing 26 is mounted in casing 20. Conventional packers 28, 30 and conventional crossover sub 32 seal or close the annulus 34 formed between casing 20 and upper sand screen assembly 16. Crossover 32 and packers 28, 30 are conventional gravel pack forming tools and are well known to those skilled in the art.

According to the present invention, the illustrated gravel pack assembly includes the multi zone isolation tool 36 of the present invention. Tool 36 is illustrated in an exemplary down hole tool assembly for descriptive purposes but it is to be understood that the tool of the present invention has application in a variety of tool configurations. Expansion joints and the like although not illustrated could be included in the tool assembly as needed.

As explained in greater detail below, tool 36 functions to selectively isolate and connect lower sand screen assembly 18 and production tubing 26 via a first flow passageway. Tool 36 also functions to selectively isolate and connect upper sand screen assembly 16 to annulus 38 via a second flow passage in tool 36. Packers 28, 30 and crossover 32 isolate annulus 34 from the first flow passageway and the remainder of the well. Thus, tool 36 selectively isolates zone 12 and zone 14 from the remainder of the well and allows zones 12, 14 to be independently produced.

Figure 2A:
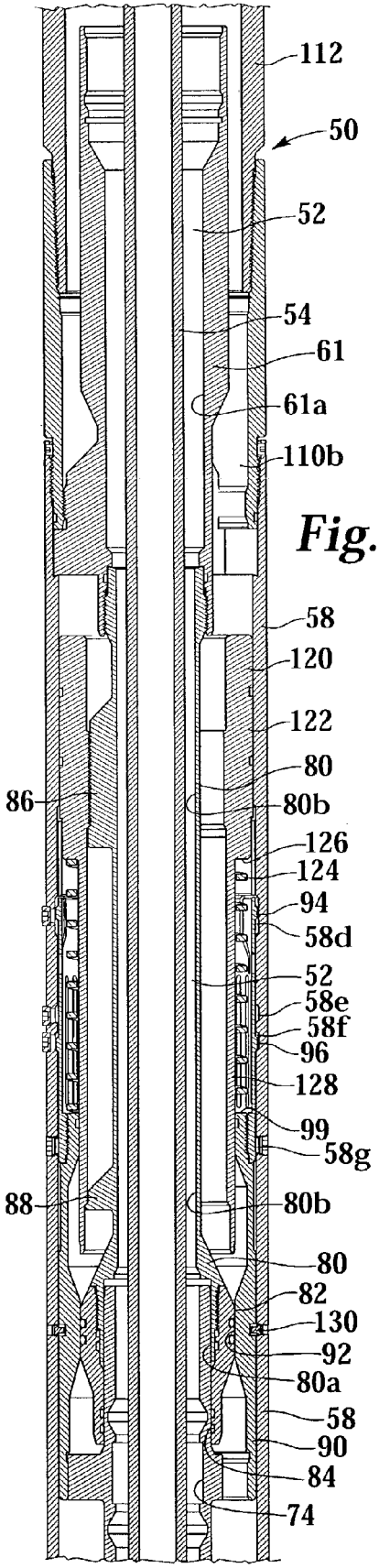
FIGS. 2A–2B are cross sectional views of successive axial sections of a multi zone isolation tool of the present invention in the closed position.
Figure 2B:
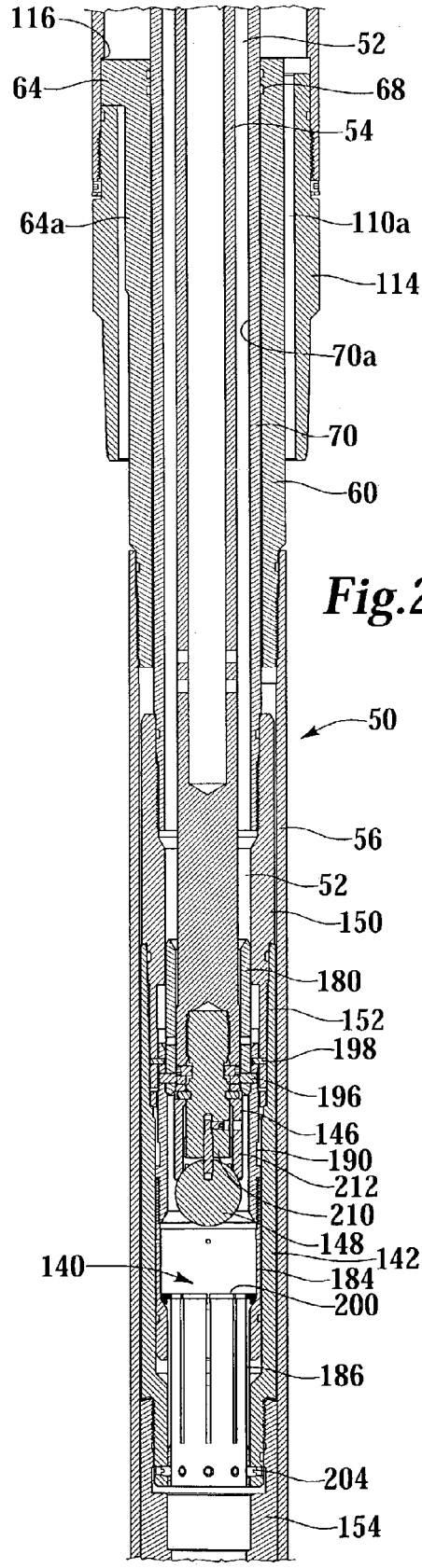

Referring next to FIGS. 2A–2B, therein is depicted a more detailed illustration of an embodiment of a multi zone isolation tool of the present invention that is generally designated 50. The previously referenced first flow passageway through tool 50 is a central passageway 52 through which a wash pipe 54 initially extends. As previously described with reference to FIG. 1, passageway 52 connects to the tubing 40 passing through lower packer 30 and connected to lower sand screen assembly 18. Specifically, as seen in FIG. 2B, tubing 56 is threaded to the downhole end of lower spacer 60 and communicates with lower sand screen assembly 18. Production tubing 26 of FIG. 1 is threadably connected at the uphole end of upper spacer 61 and tubing 26 extends to the wellhead or an upper production packer (not shown). Passageway 52 extends completely through the housing 58 of tool 50 and is formed in part by internal passageway 70A in movable sleeve 70, internal passageways 80A and 80B in valve seat mandrel 80 and internal passageway 61A in upper spacer 61. Spacer 60, mandrel 80 and sleeve 70 are shown in detail in FIGS. 3, 4 and 5, respectively.

Figure 3:
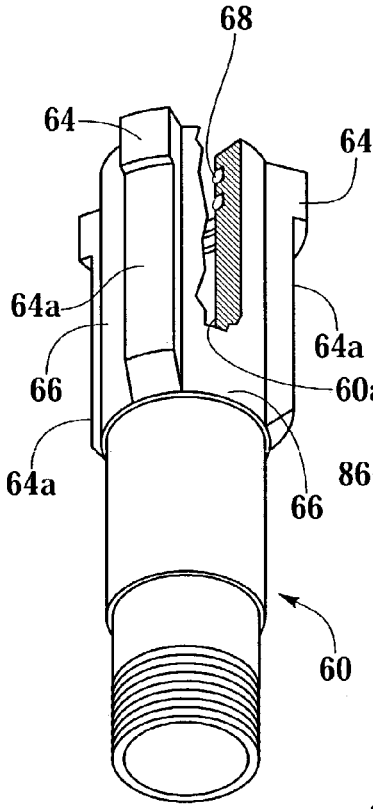
FIG. 3 is an enlarged perspective view of a lower spacer of a multi zone isolation tool of the present invention.
Figure 11A:
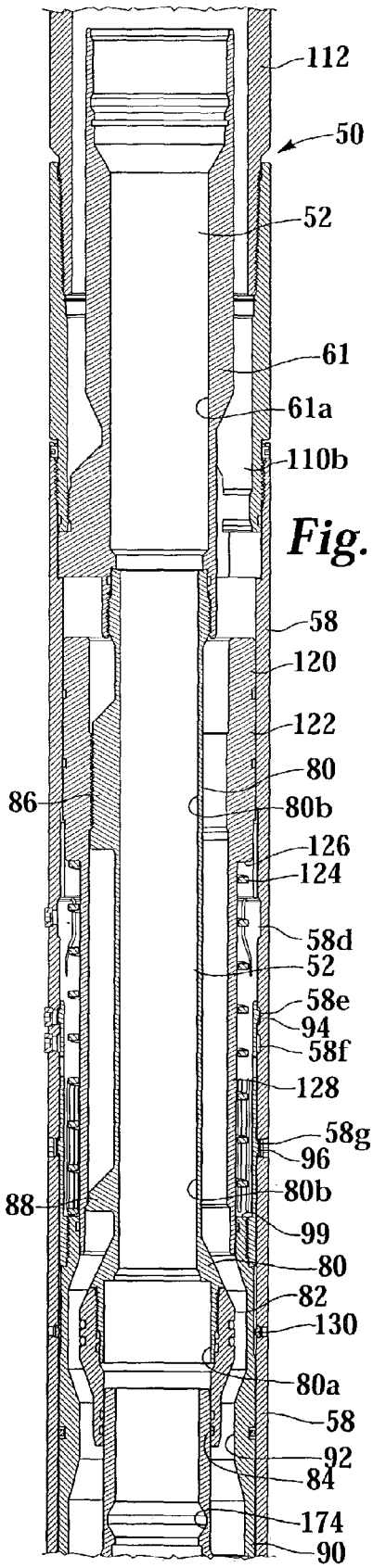
FIGS. 11A–11B are cross sectional views of successive axial sections of a multi zone isolation tool of the present invention in the open position.
Figure 11B:
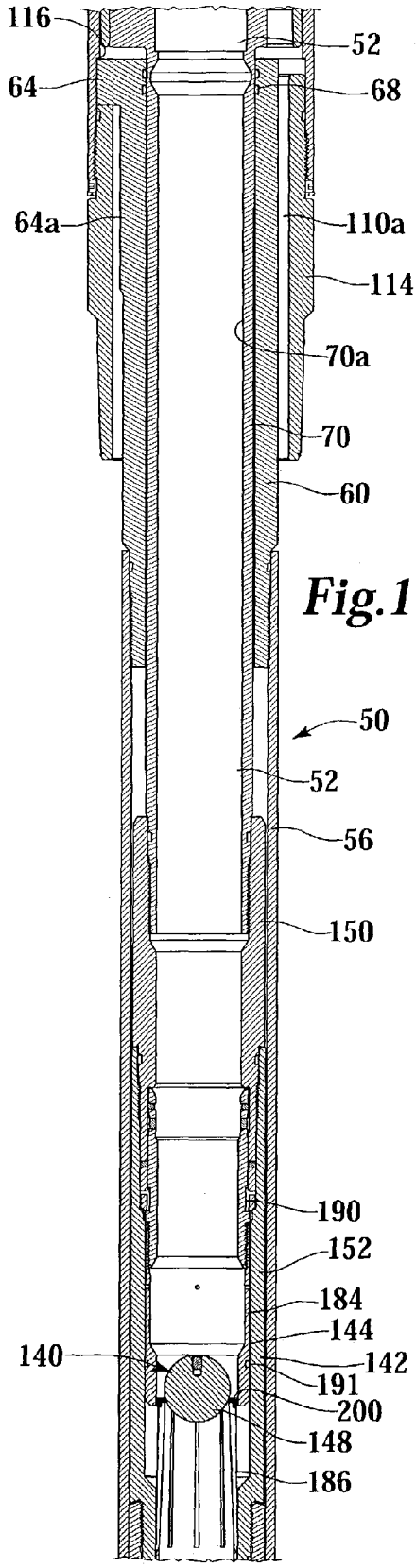

The previously referred to second fluid passageway is an annular passageway designated 110A, 110B formed inside of housing 58. The upper end of housing 58 is connected to tubing 112. Tubing 112 is connected to annulus 38 of FIG. 1. The downhole end of housing 58 is connected to adapter 114. Adapter 114 retains the radially extending legs 64 on spacer 60 against shoulder 116 inside housing 58. The reduced diameter portions 64A of these legs fit inside adapter 114. The axially extending spaces 66 between legs 64 form a portion of passageway 110A, as best seen in FIG. 3. Adapter 114 is coupled to the tubing that connects passageway 110A to the interior of upper sand screen assembly 16. In FIG. 2, tool 50 is in the closed position with passageway 110A closed from passageway 110B by the engagement between the annular valve 92 on sleeve valve 90 and seat 82 on valve seat mandrel 80. As will be described in more detail below, valve 92 can be moved away from the seat 82 to open passageway 110 through tool 50. When tool 50 is in the closed position, the interior of upper sand screen assembly 16 is closed from annulus 38 by valve 92 and seat 82. As will be described with reference to FIGS. 11A–11B, when valve 92 is separated axially from seat 82, fluid from inside upper sand screen assembly 16 flows into annulus 38 and to the wellhead (not shown).

Figure 5:
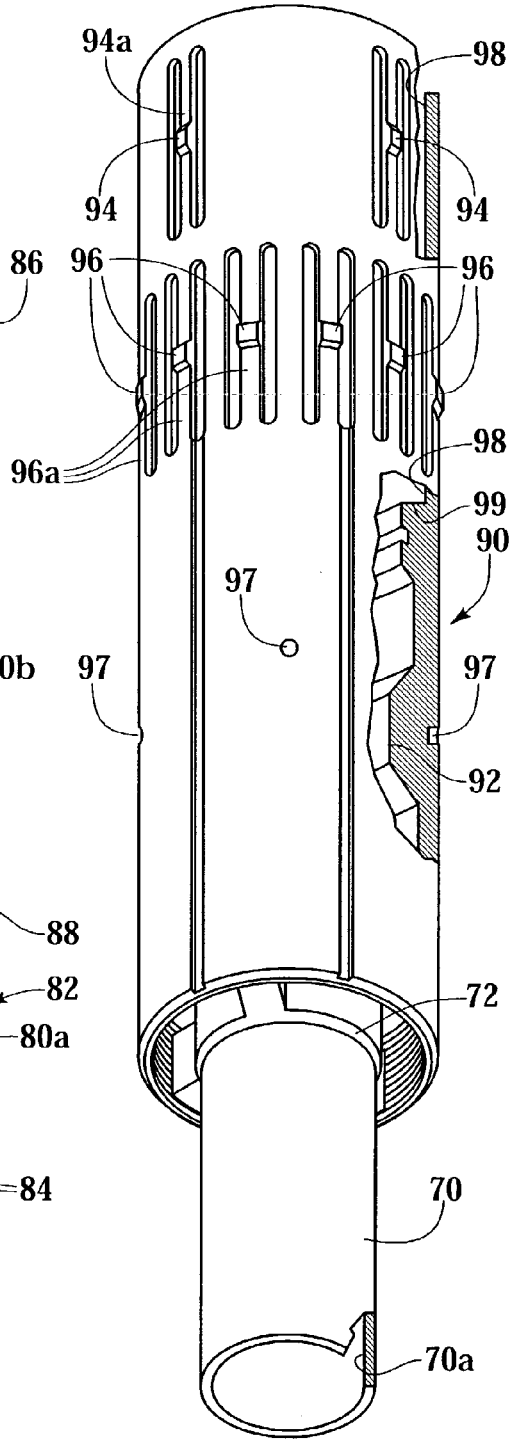
FIG. 5 is an enlarged perspective view of a moveable sleeve positioned within a sleeve valve of a multi zone isolation tool of the present invention.

The assembly of sleeve 70 and sleeve valve 90 is illustrated in FIG. 5. Sleeve 70 is connected by a spider ring 72 to the downhole end of sleeve valve 90. As illustrated in FIGS. 2A–2B, the downhole end of sleeve 70 extends through lower spacer 60. Suitable seals or packing 68 provide a sliding seal between the sleeve 70 and spacer 60. The uphole end of sleeve 70 telescopes into the passageway 80A of valve seat mandrel 80. Suitable seals or packing 84 forms a sliding seal between sleeve 70 and passageway 80A of valve seat mandrel 80. A profile 74 is formed within passageway 70A. Profile 74 is exposed to the interior of the first flow passageway 52 and can be accessed through production tubing 26. Since sleeve 70 is mechanically connected to the axially movable sleeve valve 90, valve element 92 can be axially moved into and out of contact with valve seat 82 by engaging and axially moving profile 74 on sleeve 70. In this manner, a tool can be run through tubing 26 to engage profile 74 to axially move sleeve 70 and sleeve valve 90 to manually open or close second passageway 110A and 110B.

As illustrated in FIG. 5, two sets of axially spaced lugs 94, 96 are formed on the exterior of an upper portion 98 of sleeve valve 90. Lug sets 94, 96 are each positioned on radially compressible longitudinally extending springs 94A, 96A, respectively. These springs allow the lugs when forced radially inward to deflect the springs into the internal bore of housing 58. Valve sleeve 90 is mounted to slide in the interior bore of housing 58. According to a particular feature of the present invention, axially spaced annular grooves 58D, 58E 5SF and 58G are formed in the wall of the interior bore of housing 58. Lugs 94, SE are of a size and shape to engage or extend into these grooves. The springs 94A, 96A resiliently urge the lugs radially outward to latch in the grooves to temporarily locate sleeve valve 90 in discrete axial positions. Moving sleeve valve 90 between the open and closed positions requires locking and unlocking the lug sets into and out of the grooves. Note that the axial force needed to latch and unlatch lugs 94 from the grooves is designed to be less than the force needed to unlatch lugs 96. This is accomplished by providing a larger number of lugs 96 on springs 96A that are stiffer. In the closed position illustrated in FIG. 2A–2B, lugs 94 are located in slot 58D and lugs 96 are located in slot 58F.

Figure 4:
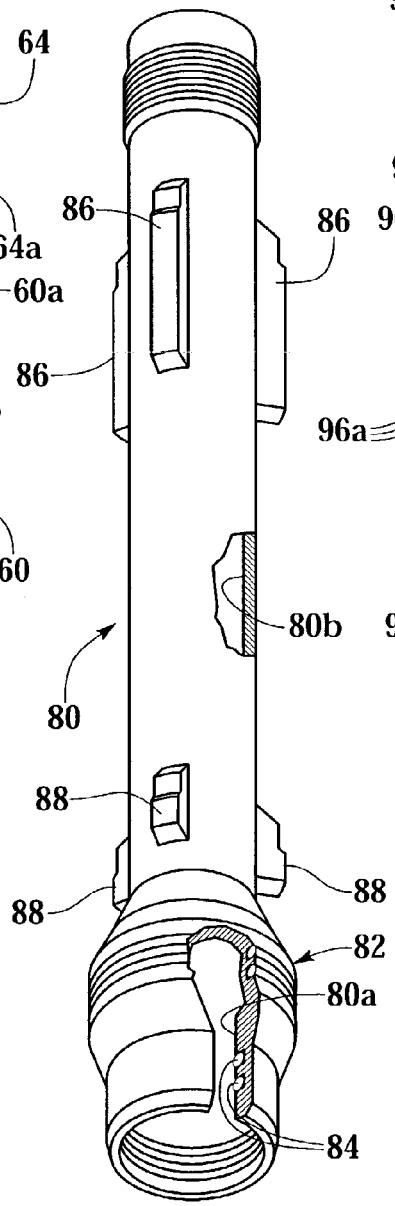
FIG. 4 is an enlarged perspective view of a valve seat mandrel of a multi zone isolation tool of the present invention.

According to the present invention, an actuator assembly 120 is located in tool 50 to open passageway 110 in response to pressure being applied within passageway 52. Actuator assembly 120 includes housing 122 and coil spring 124 that are concentrically mounted around valve seat mandrel 80. Spring 124 is compressed between annular shoulder 126 and annular shoulder 99. The force of spring 124 urges sleeve valve 90 in a downhole direction to separate valve element 92 from seat 82. Spring 124 is designed to apply sufficient force to unlock or dislodge lugs 94 from slot 58D but insufficient force to unlock lugs 96 from slot 58F. In the closed position, the locking force of lugs 96 in slots 58F holds sleeve valve 90 in the closed position. Housing 122 includes a cylindrical portion 128 of a size to extend through spring 124 and is centered and supported from radially extending legs 86, 88 on valve seat mandrel 80, as best seen in FIG. 4.

Sleeve valve 90 is initially held in place by shear screws 130. In the illustrated embodiment a plurality of radially extending circumferentially spaced shear screws 130 are used. Shear screws 130 are threaded into housing 58 and extend into radially extending bores 97 in sleeve valve 90. When sufficient axial force is applied to sleeve 70, shear screws 130 will sever allowing sleeve valve 90 to move axially from the position shown in FIGS. 2A–2B to the position shown in FIGS. 11A–11B.

After the operations requiring wash pipe 54 are performed such as gravel packing or fracturing lower zone 14 of FIG. 1, it is often desired to protect lower zone 14 from other operations in upper zone 12 by sealing off lower zone 14 from upper zone 12 while these other operations are being performed. To seal off lower zone 14 from upper zone 12, the lower seal portion 140 of isolation tool 50 is activated and wash pipe 54 is withdrawn from lower sand screen assembly 18, production tubing 40, upper sand screen assembly 16 and isolation tool 50. Once the operations above lower zone 14 are completed, lower seal portion 140 may be deactivated or cleared to allow communication with production tubing 26.

Lower seal portion 140 generally comprises a housing 142, a seal assembly 144, a running tool assembly 146 and a plug or ball 148. Housing 142 comprises a top sub 150, a middle sub 152 and a bottom sub 154. An upper portion of top sub 150 threadably attaches to the lower end of sleeve 70 and a lower portion of top sub 150 attaches to an upper portion of middle sub 152. An upper portion of bottom sub 154 attaches to a lower portion of middle sub 152.

Top sub 150 has a first inner diameter 156 in the upper portion, and a larger second inner diameter 158 in the lower portion creating a stop land 160 therebetween. Middle sub 152 has a first inner diameter 162 in the upper portion and a second inner diameter 164 in the lower portion forming a stop land 166 therebetween. Bottom sub 154 has an inner diameter 168. In one embodiment, first inner diameter 156 of top sub 150 is approximately the same diameter as second inner diameter 164 of middle sub 152 and inner diameter 168 of bottom sub 154. A snap ring groove 170 is defined in the upper portion of middle sub 152. A snap ring 172 resides within snap ring groove 170.

In one embodiment, seal assembly 144 includes a shear ring 180, a sleeve 182 and a sleeve extension 184 which contacts a collet seat assembly 186. At the upper end of sleeve 182, a sleeve stop edge 188 is created between the outer diameter and the inner diameter. A snap ring groove 190 is recessed into the outer diameter of sleeve 182. At the lower end of sleeve extension 184, a compression land 192 is created by decreasing the inner diameter of sleeve extension 184. A seal 191 resides within a seal groove 193 that is recessed into the outer diameter of sleeve extension 184.

Shear ring 180 has an inner diameter larger than the diameter of wash pipe 54. A running tool interface edge 194 is created on a lower edge of shear ring 180 between the outer diameter and the inner diameter. Shear ring 180 is secured to sleeve 182 by a plurality of shear pins 196 disposed within shear pin apertures in shear ring 180 and shear pin apertures in sleeve 182. Sleeve 182 is secured to housing 142 by a plurality of shear pins 198 that engage shear pin apertures in sleeve 182 and shear pin apertures in top sub 150 of housing 142.

Collet seat assembly 186 has a collet seat 200 on the upper portion thereof. A compression land 202 is created on an upper portion of collet seat 200 by increasing the outer diameter of collet seat 200 to a diameter larger than the inner diameter of compression land 192 of sleeve extension 184. Collet seat assembly 186 is secured to housing 142 by a plurality of shear pins 204 secured within shear pin apertures in collet seat assembly 186 and shear pin apertures in middle sub 152 of housing 142.

Running tool 146 includes a running tool mandrel 210 and a running tool shear sleeve 212. The upper end of running tool mandrel 210 is received within a wash pipe mounting aperture and is secured therein with a plurality of set screws 214. Running tool mandrel 210 has a stop land 216 on a lower portion thereof. Running tool shear sleeve 212 has an outer diameter that is greater than the inner diameter of shear ring 180. A stop land 218 is created inside running tool shear sleeve 212 between a first inner diameter and a second inner diameter such that running tool shear sleeve 212 will engage stop land 216 of running tool mandrel 210.

A shear ring interface edge 220 is located on the upper edge of running tool shear sleeve 212 such that axial engagement with running tool interface edge 194 of shear ring 180 is possible. At the lower edge of running tool shear sleeve 212, a ball interface surface 222 is defined. Running tool shear sleeve 212 is mounted to running tool mandrel 210 by a plurality of shear pins 224 secured within shear pin apertures in running tool shear sleeve 212 and shear pin apertures in running tool mandrel 210.

Ball 148 has an outer diameter 230 that is smaller than the inner diameter of collet seat assembly 186 in a relaxed position. A ball attachment bolt 232 initially threadably secures ball 148 to running tool mandrel 210. Ball attachment bolt 232 has a radially reduced area which is located below outer diameter 230 of ball 148.

The various operations of isolation tool 50 will now be described. First, the operation of isolating lower zone 14 of FIG. 1 to prevent fluid flow from above lower seal portion 140 into lower zone 14 will be described. Then the operation of opening valve 90 to allow fluid from between upper zone 16 and annulus 38 will be described. Next, the operation of reopening fluid flow between lower zone 14 and tubing 26 will be described.

Figure 6:
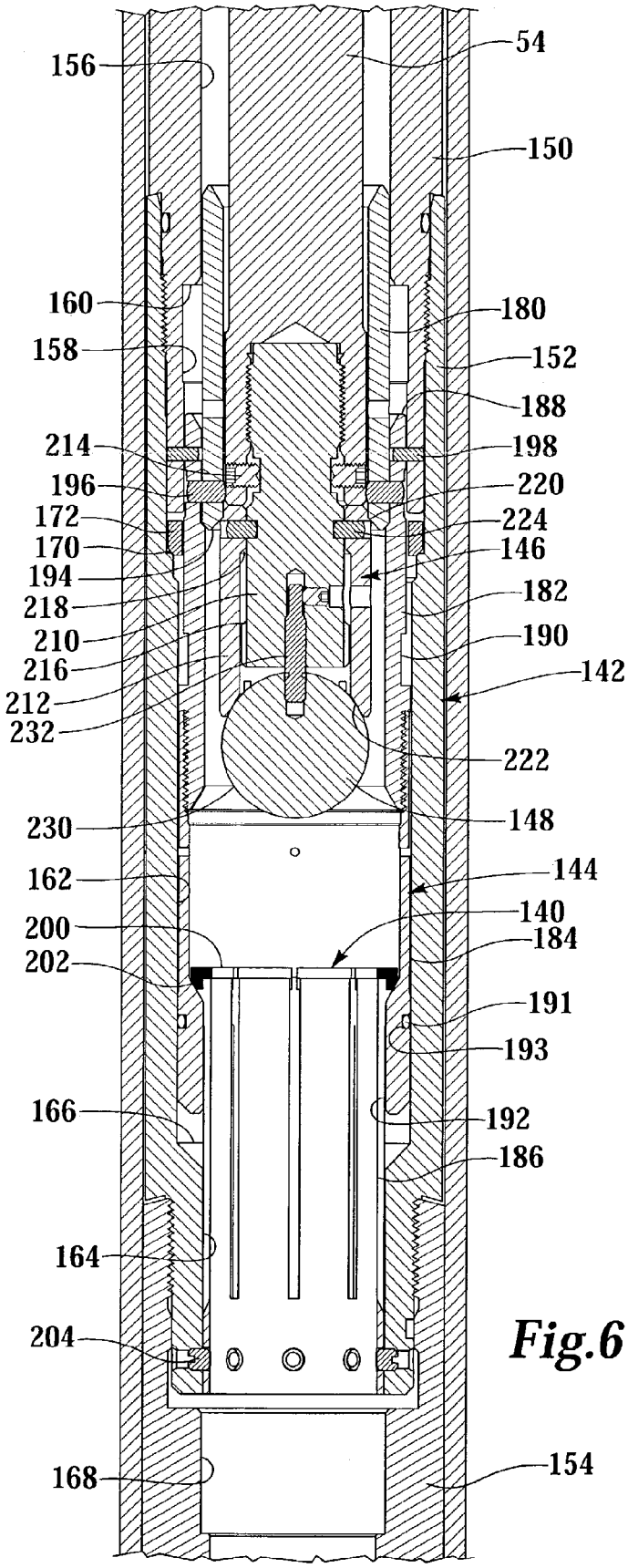
FIG. 6 is an enlarged cross sectional view of a lower seal portion of a multi zone isolation tool of the present invention in an open position.
Figure 7:
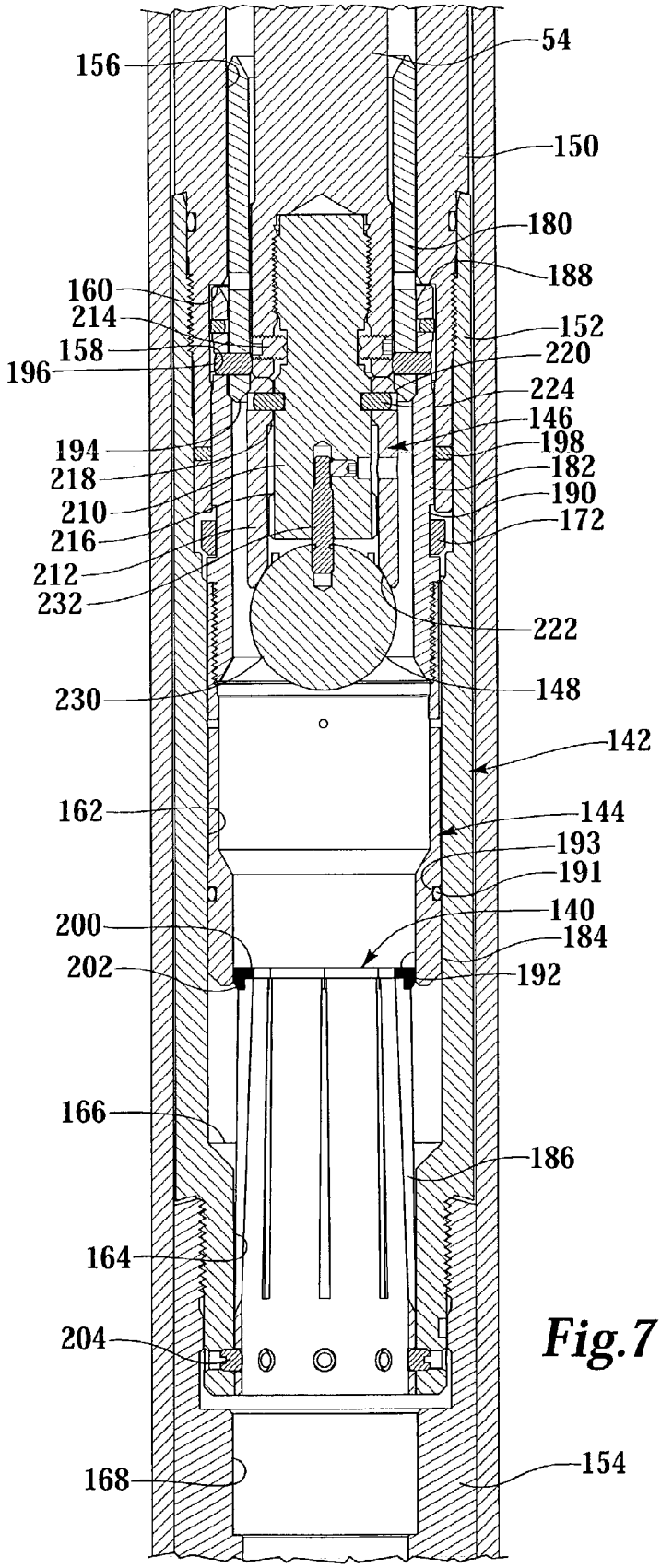
FIG. 7 is an enlarged cross sectional view of a lower seal portion of a multi zone isolation tool of the present invention wherein a collet seat is compressed.

First, wash pipe 54 and running tool 146 are drawn upwardly through lower sand screen assembly 18, tubing 40, upper sand screen assembly 16 and isolation tool 50 until shear ring interface edge 220 on running tool shear sleeve 212 engages running tool interface edge 194 on shear ring 180, as best seen in FIGS. 2A–2B and 6. Wash pipe 54 continues to be lifted upwardly through isolation tool 50 until running tool 146 shears shear pins 198 allowing seal assembly 144 to progress upwardly through isolation tool 50 with running tool 146 and wash pipe 54, as best seen in FIG. 7. As seal assembly 144 progresses upwardly with running tool 146 and wash pipe 54 through isolation tool 50, compression land 192 of sleeve extension 184 will engage compression land 202 of collet seat assembly 186, thereby reducing the inner diameter of collet seat 200.

At a point where compression land 192 of sleeve extension 184 reduces the inner diameter of collet seat 200 to a diameter smaller than the outer diameter 230 of ball 148, snap ring 172 will engage snap ring groove 190 in sleeve 182, thus preventing further upward movement of seal assembly 144 in isolation tool 50. In the position where snap ring 172 engages snap ring groove 190, seal 191 will engage the inner diameter of middle sub 152 of housing 142. After snap ring 172 engages snap ring groove 190, movement of wash pipe 54 upwardly will sever shear pins 224 that secure running tool shear sleeve 212 to running tool mandrel 210.

Figure 8:
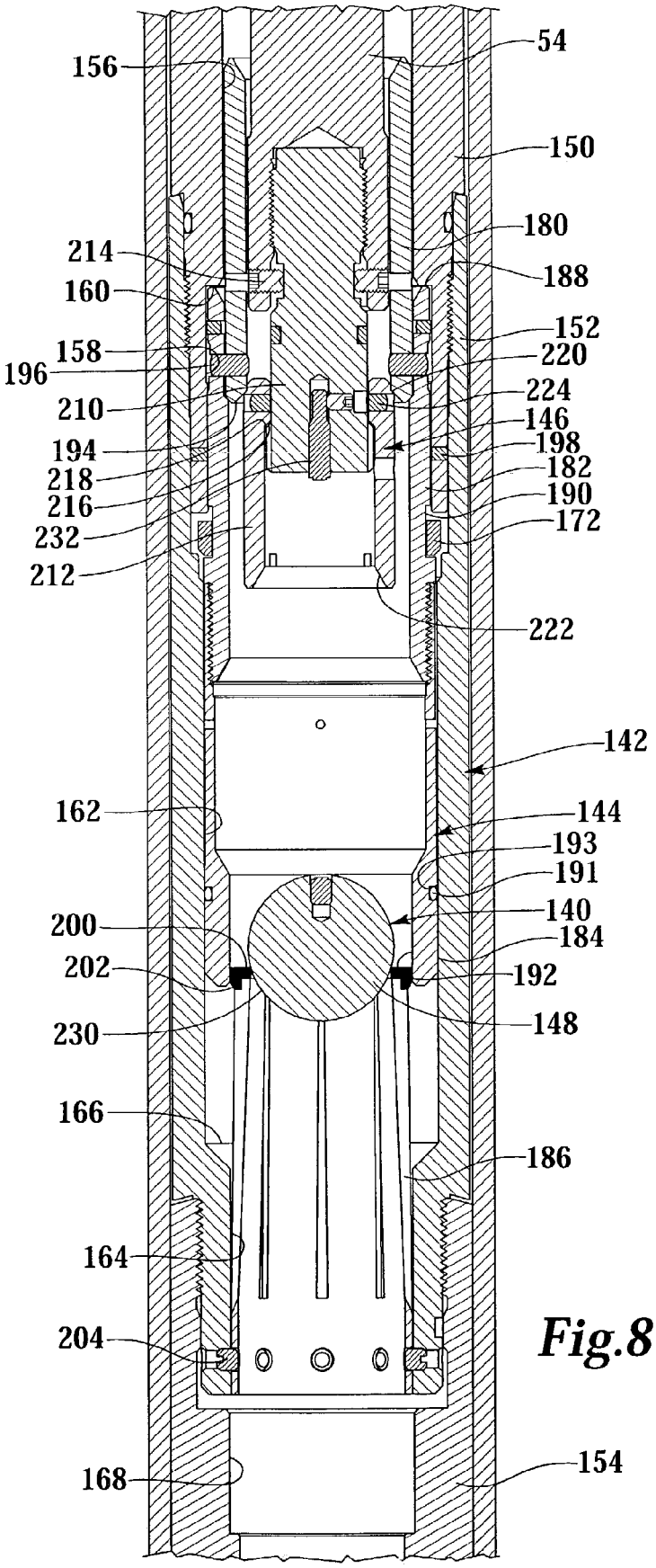
FIG. 8 is an enlarged cross sectional view of a lower seal portion of a multi zone isolation tool of the present invention in a closed position.

The force of wash pipe 54 and running tool 146 being drawn upwardly through isolation tool 50 will also cause ball attachment bolt 232 to sever at the radially reduced area below the outer diameter 230 of ball 148. Once ball attachment bolt 232 is severed, ball 148 will drop into engagement with collet seat 200 of collet seat assembly 186, thereby blocking flow through lower seal portion 140 of isolation tool 50, as best seen in FIG. 8. After ball 148 has separated from running tool mandrel 210, stop land 218 of running tool shear sleeve 212 will engage stop land 216 of running tool mandrel 210.

Figure 9:
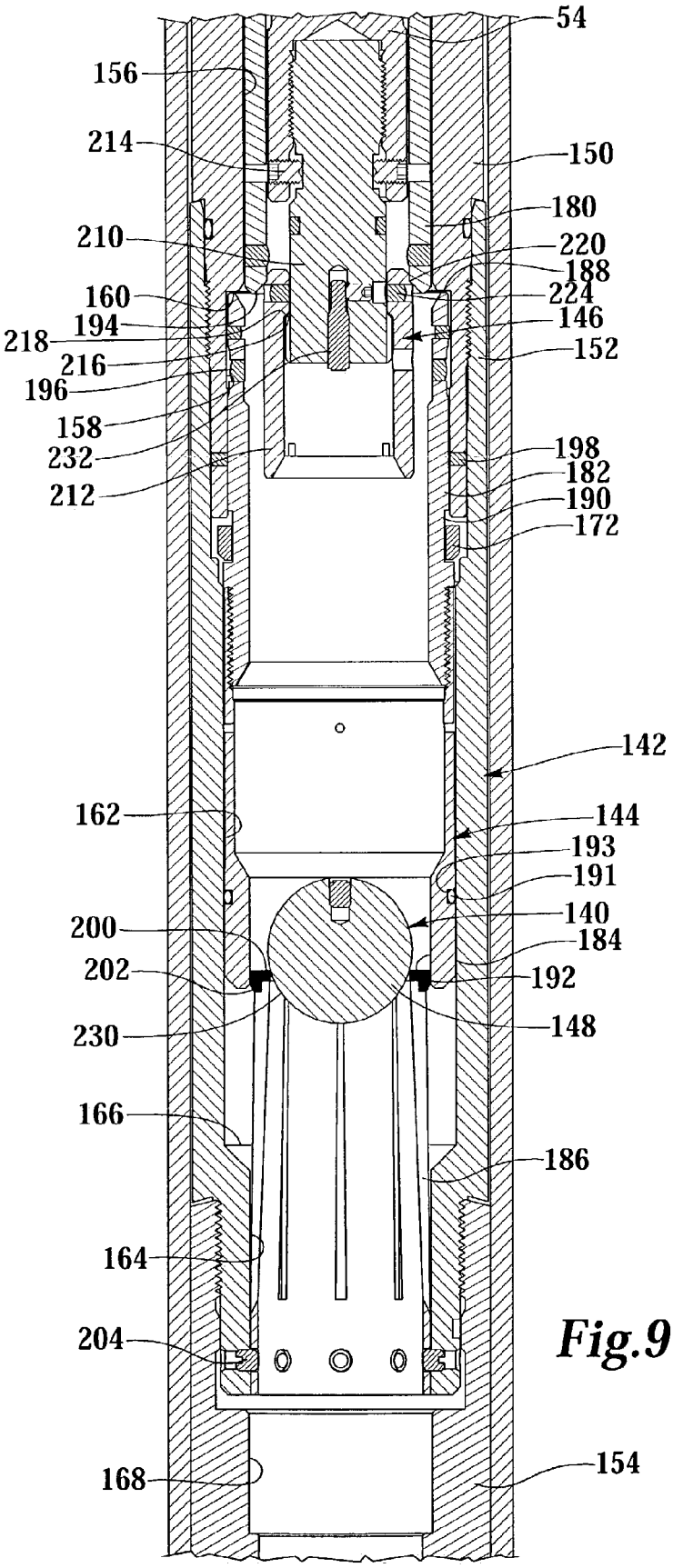
FIG. 9 is an enlarged cross sectional view of a lower seal portion of a multi zone isolation tool of the present invention in a closed position wherein a washpipe is being removed therefrom.

Continued upward forces on wash pipe 54 and running tool 146 will be transmitted by shear ring interface edge 194 to running tool interface edge 220, severing shear pins 196 connecting shear ring 180 to sleeve 182, as best seen in FIG. 9. Removal of wash pipe 54 and running tool 146 from isolation tool 50 leaves ball 148 sealed against collet seat 200, thereby restricting flow from above lower seal portion 140 of isolation tool 50 to below lower seal portion 140 of isolation tool 50.

Figure 10A:
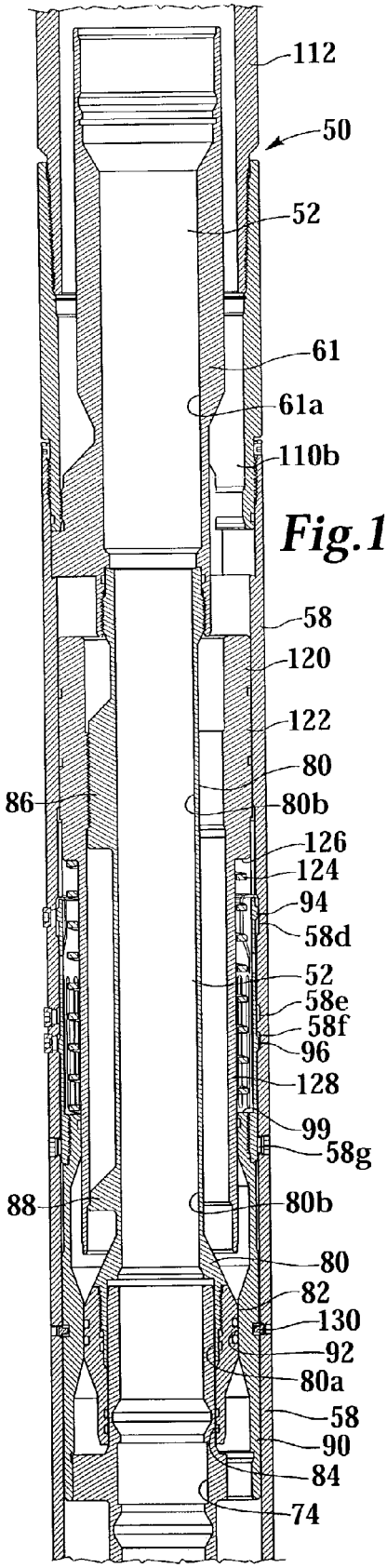
FIGS. 10A–10B are cross sectional views of successive axial sections of a multi zone isolation tool of the present invention in the closed position and fluid loss prevention configuration.
Figure 10B:
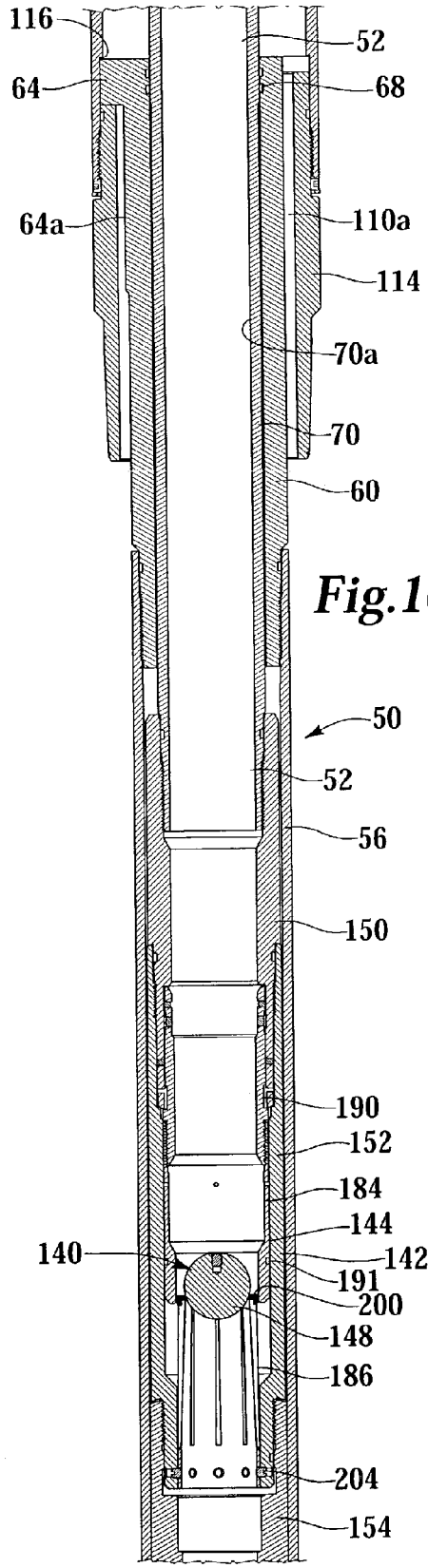

As best seen in FIGS. 10A–10B, once ball 148 has separated from running tool mandrel 210 and engaged collet seat 200, isolation tool 50 is in a fluid loss prevention configuration. In the fluid loss prevention configuration, seal 191 provides a seal between housing 142 and seal assembly 144, and collet seat 200 provides a seal with ball 148. Thus, in the fluid loss prevention configuration, isolation tool 50 prohibits communication from above lower seal portion 140 of isolation tool 50 to below lower seal portion 140 of isolation tool 50.

Once lower zone 14 is serviced as required while upper zone 12 is isolated and then lower zone 14 is isolated as described above, access to upper zone 12 can be accomplished by raising the pressure in passageway 52, which causes valve 190 in isolation tool 50 to open. Specifically, the pressure within passageways 52 creates a downwardly acting force on ball 148 in collet seat 200. As collet seat assembly 186 is connected to middle sub 152 of housing 142 and as top sub 150 is connected to the lower end of sleeve 70 which is connected to sleeve valve 90, this downwardly acting force is transferred to shear screws 130 that secure sleeve valve 90 to housing 58. Once the force reaches the required level, shear screws 130 are severed, releasing sleeve valve 90 from housing 58. Once sleeve valve 90 is released from housing 58, the downwardly acting force on ball 148 together with the downwardly acting force generated by spring 124 act on sleeve valve 90 causing sleeve valve 90 to move from the position shown in FIGS. 10A–10B to the position shown in FIGS. 11A–11B.

This configuration of isolation tool 50 allows access to upper zone 12 as sleeve valve 90 is in the open position allowing fluid communication through passageway 110. At the same time, isolation tool 50 prevents fluid loss to lower zone 14 as seal 191 provides a seal between housing 142 and seal assembly 144, and collet seat 200 provides a seal with ball 148. Once isolation tool 50 has been operated to this configuration, sleeve valve 90 can be opened or closed as desired by lowering a tool through the production string and engaging profile 74 to mechanically raise or lower sleeve 70 which opens or closes sleeve valve 90. When sleeve valve 90 is returned to the closed position as seen in FIGS. 10A–10B, the locking force of lugs 96 in slots 58F holds sleeve valve 90 in the closed position. The reopening of sleeve valve 90 can be accomplished by raising the pressure in passageway 52 or use of the mechanical shifter tool.

Figure 12:
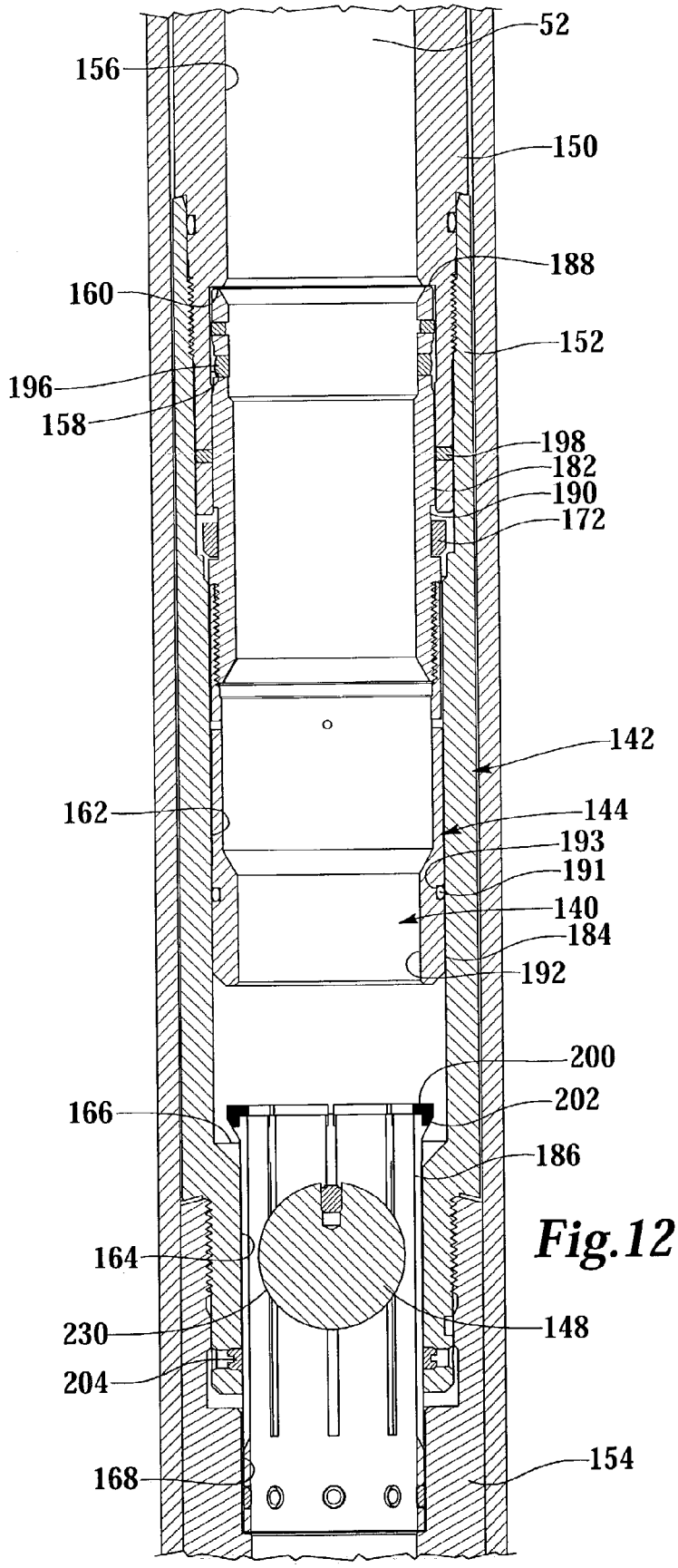
FIG. 12 is an enlarged cross sectional view of a lower seal portion of a multi zone isolation tool of the present invention in a reopened position.

At some point after ball 148 engages collet seat 200 preventing flow downward through isolation tool 50, it will be desired to reopen access to lower zone 14. To allow flow to resume through passageway 52 of isolation tool 50, ball 148 must be cleared from collet seat 200, as best seen in FIG. 12. Ball 148 can be forced clear of collet seat 200 by raising the pressure within passageway 52 to a sufficient level to sever shear pins 204 which connect collet seat assembly 186 to middle sub 152 of housing 142. When the force exerted on ball 148 is great enough to sever shear pins 204, ball 148 and collet seat assembly 186 will progress downwardly through housing 142 until compression land 202 of collet seat assembly 186 clears compression land 192 of sleeve extension 184. Once compression land 202 of collet seat assembly 186 clears compression land 192 of sleeve extension 184, collet seat 200 will expand until compression land 192 of collet seat assembly 186 resides in a relaxed position between sleeve extension 184 and stop land 166 of housing 142. Expansion of collet seat 200 will allow ball 148 to pass through collet seat 200 and exit isolation tool 50. After ball 148 exits isolation tool 50, ball 148 will pass through upper sand screen assembly 16, tubing 40, lower sand screen assembly 18 and the sump packer into the sump.

Even though FIG. 12 has been described as clearing ball 148 from collet seat 200 using pressure within passageway 52, it should be understood by those skilled in the art that other techniques could alternatively be used to clear ball 148 from collet seat 200 including, but not limited to, mechanically pushing ball 148 or chemically attacking ball 148.

Once ball 148 has been cleared from collet seat 200, sleeve valve 90 can still be opened or closed as desired to prevent or permit fluid flow between upper zone 12 and annulus 38. Specifically, this is accomplished by lowering a tool through the production string and engaging profile 74 to mechanically raise or lower sleeve 70 which opens or closes sleeve valve 90. When sleeve valve 90 is returned to the closed position as seen in FIGS. 10A–10B, the locking force of lugs 96 in slots 58F holds sleeve valve 90 in the closed position. The reopening of sleeve valve 90 can be accomplished by use of the mechanical shifter tool.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A multi zone isolation tool for use in a subterranean wellbore to selectively control fluid flow relative to first and second zones, the tool comprising:

a first tubular and a second tubular disposed within the first tubular forming an annular flow path therebetween that is in fluid communication with the first zone, the second tubular defining a central flow path therein that is in fluid communication with the second zone;

an annular valve and annular seat positioned in the annular flow path to control fluid flow therethrough, the annular valve being axially movable relative to the annular seat between a closed position wherein the annular valve is adjacent to the annular seat and an open position wherein the annular valve is axially displaced from the annular seat; and a central valve and central seat positioned in the central flow path to control fluid flow therethrough, the central valve being axially movable in a first direction relative to the central seat from an open position wherein the central valve is axially displaced from the central seat to a closed position wherein the central valve is positioned within the central seat, the central valve being axially movable in the first direction relative to the central seat from the closed position to a reopen position wherein the central valve passes through the central seat, the central seat being operably coupled to the annular valve such that when the central valve and central seat are in the closed position, a pressure variation in the central flow path will operate the annular valve and annular seat from the closed position to the open position.

2. The multi zone isolation tool as recited in claim 1 further comprising a sleeve that operably couples the central seat to the annular valve.

3. The multi zone isolation tool as recited in claim 2 wherein the sleeve forms at least a portion of the second tubular.

4. The multi zone isolation tool as recited in claim 2 wherein the sleeve is slidably received within the annular seat.

5. The multi zone isolation tool as recited in claim 1 wherein the annular seat is slidably received within the annular valve.

6. The multi zone isolation tool as recited in claim 1 further comprising a spring resiliently urging the annular valve toward the open position.

7. The multi zone isolation tool as recited in claim 1 further comprising a latch operably associated with the annular valve to maintain the annular valve in one of the open and closed positions.

8. The multi zone isolation tool as recited in claim 7 wherein the latch comprises a collet spring with lugs engaging recesses.

9. The multi zone isolation tool as recited in claim 1 wherein the pressure variation comprises raising the pressure in the central flow path to a first predetermined level.

10. The multi zone isolation tool as recited in claim 9 wherein the central valve and central seat are operated from the closed position to the reopen position by raising the pressure in the central flow path to a second predetermined level that is higher than the first predetermined level.

11. The multi zone isolation tool as recited in claim 1 wherein the central valve is a detachable plug.

12. The multi zone isolation tool as recited in claim 1 wherein the central seat further comprises a collet seat having a retracted configuration wherein the central valve can pass through the central seat and a compressed configuration wherein the central valve can be sealingly received in the collet seat.

13. A multi zone isolation tool for use in a subterranean wellbore, the tool comprising:

a first tubular and a second tubular disposed within the first tubular forming an annular flow path therebetween, the second tubular defining a central flow path therein;

an annular valving assembly positioned in the annular flow path to control fluid flow therethrough, the annular valving assembly operable between a closed position and an open position; and a central valving assembly positioned in the central flow path to control fluid flow therethrough, the central valving assembly operable from an open position to a closed position and from the closed position to a reopen position, the central valving assembly operably coupled to the annular valving assembly such that when the central valving assembly is in the closed position, a pressure variation in the central flow path will operate the annular valving assembly from the closed position to the open position.

14. The multi zone isolation tool as recited in claim 13 wherein the annular valving assembly further comprises an annular valve and annular seat positioned in the annular flow path to control fluid flow therethrough, the annular valve being axially movable relative to the annular seat between the closed position and the open position.

15. The multi zone isolation tool as recited in claim 14 wherein the central valving assembly further comprises a central valve and central seat positioned in the central flow path to control fluid flow therethrough, the central valve being axially movable relative to the central seat from the open position to the closed position and from the closed position to the reopen position, the central seat being operably coupled to the annular valve such that when the central valve and central seat are in the closed position, a pressure variation in the central flow path will operate the annular valve and annular seat from the closed position to the open position.

16. The multi zone isolation tool as recited in claim 15 further comprising a sleeve that operably couples the central seat to the annular valve.

17. The multi zone isolation tool as recited in claim 16 wherein the sleeve forms at least a portion of the second tubular.

18. The multi zone isolation tool as recited in claim 16 wherein the sleeve is slidably received within the annular seat.

19. The multi zone isolation tool as recited in claim 15 wherein the annular seat is slidably received within the annular valve.

20. The multi zone isolation tool as recited in claim 15 further comprising a spring resiliently urging the annular valve toward the open position.

21. The multi zone isolation tool as recited in claim 15 further comprising a latch operably associated with the annular valve to maintain the annular valve in one of the open and closed positions.

22. The multi zone isolation tool as recited in claim 21 wherein the latch comprises a collet spring with lugs engaging recesses.

23. The multi zone isolation tool as recited in claim 13 wherein the pressure variation comprises raising the pressure in the central flow path to a first predetermined level.

24. The multi zone isolation tool as recited in claim 23 wherein the central valving assembly is operated from the closed position to the reopen position by raising the pressure in the central flow path to a second predetermined level that is higher than the first predetermined level.

25. The multi zone isolation tool as recited in claim 13 wherein the central valving assembly further comprises a detachable plug.

26. The multi zone isolation tool as recited in claim 13 wherein the central valving assembly further comprises a collet seat having a retracted configuration and a compressed configuration.

27. A completion system for a wellbore comprising:

a tool string having first and second sand control screens, first and second packers, a cross over assembly and a multi zone isolation tool, the multi zone isolation tool including:

a first tubular and a second tubular disposed within the first tubular forming an annular flow path therebetween that is in communication the first sand control screen, the second tubular defining a central flow path therein that is in communication with the second sand control screen;

an annular valving assembly positioned in the annular flow path to control fluid flow therethrough, the annular valving assembly operable between a closed position and an open position; and a central valving assembly positioned in the central flow path to control fluid flow therethrough, the central valving assembly operable from an open position to a closed position and from the closed position to a reopen position, the central valving assembly operably coupled to the annular valving assembly such that when the central valving assembly is in the closed position, a pressure variation in the central flow path will operate the annular valving assembly from the closed position to the open position.

28. A method for selectively controlling fluid flow between a wellbore and first and second zones, the method comprising the steps of:

disposing a multi zone isolation tool within the wellbore, the tool including a first tubular and a second tubular disposed within the first tubular forming an annular flow path therebetween that is in fluid communication with the first zone, the second tubular defining a central flow path therein that is in fluid communication with the second zone;

positioning an annular valving assembly in the annular flow path to control fluid flow therethrough;

positioning a central valving assembly in the central flow path to control fluid flow therethrough;

operably coupling the central valving assembly to the annular valving assembly;

operating the central valving assembly from an open position to a closed position;

varying the pressure in the central flow path such that the central valving assembly operates the annular valving assembly from the closed position to the open position; and operating the central valving assembly from the closed position to a reopen position.

29. The method as recited in claim 28 wherein the step of positioning an annular valving assembly in the annular flow path to control fluid flow therethrough further comprises positioning an annular valve and annular seat in the annular flow path to control fluid flow therethrough.

30. The method as recited in claim 29 further comprising the step of slidably receiving the annular seat within the annular valve.

31. The method as recited in claim 29 wherein the step of operating the annular valve and annular seat from the closed position to the open position further comprises axially displacing the annular valve relative to the annular seat.

32. The method as recited in claim 29 wherein the step of operating the annular valve and annular seat from the closed position to the open position further comprises resiliently urging the annular valve toward the open position with a spring.

33. The method as recited in claim 29 further comprising the step of maintaining the annular valve in one of the open and closed positions with a latch operably associated with the annular valve, the latch including a collet spring with lugs engaging recesses.

34. The method as recited in claim 29 wherein the step of positioning a central valving assembly in the central flow path to control fluid flow therethrough further comprises positioning a central valve and central seat in the central flow path to control fluid flow therethrough.

35. The method as recited in claim 34 further comprising the step of operably coupling the central seat to the annular valve with a sleeve.

36. The method as recited in claim 35 further comprising the step of slidably receiving the sleeve within the annular seat.

37. The method as recited in claim 34 wherein the step of operating the central valving assembly from an open position to a closed position further comprises operating the central seat from a retracted configuration wherein the central valve can pass through the central seat to a compressed configuration wherein the central valve can be sealingly received in the central seat.

38. The method as recited in claim 34 wherein the step of operating the central valving assembly from an open position to a closed position further comprises detaching a plug.

39. The method as recited in claim 28 further comprising the step of operating the annular valving assembly from the open position to the closed position.

40. The method as recited in claim 28 wherein the step of varying the pressure in the central flow path to operate the annular valving assembly from the closed position to the open position further comprises raising the pressure in the central flow path to a first predetermined level.

41. The method as recited in claim 40 wherein the step of operating the central valving assembly from the closed position to a reopen position further comprises raising the pressure in the central flow path to a second predetermined level that is higher than the first predetermined level.

42. A method for selectively controlling fluid flow between a wellbore and first and second zones, the method comprising the steps of:

disposing a multi zone isolation tool within the wellbore, the tool including a first tubular and a second tubular disposed within the first tubular forming an annular flow path therebetween that is in fluid communication with the first zone, the second tubular defining a central flow path therein that is in fluid communication with the second zone;

positioning, in a closed position, an annular valve and annular seat in the annular flow path to control fluid flow therethrough;

positioning, in an open position, a central valve and central seat in the central flow path to control fluid flow therethrough;

operably coupling the central seat to the annular valve;

accessing the first zone through the central flow path;

operating the central valve and central seat from the open position to a closed position to prevent fluid loss to the first zone;

varying the pressure in the central flow path to operate the annular valve and annular seat from the closed position to the open position;

accessing the second zone through the annular flow path; and operating the central valve and central seat from the closed position to a reopen position.

43. A method for producing hydrocarbons from a wellbore that traverses first and second zones comprising the steps of:

disposing a multi zone isolation tool within the wellbore, the tool including a first tubular and a second tubular disposed within the first tubular forming an annular flow path therebetween that is in fluid communication with the first zone, the second tubular defining a central flow path therein that is in fluid communication with the second zone;

positioning an annular valving assembly in the annular flow path to control fluid flow therethrough;

positioning a central valving assembly in the central flow path to control fluid flow therethrough;

operably coupling the central valving assembly to the annular valving assembly;

operating the central valving assembly from an open position to a closed position;

varying the pressure in the central flow path such that the central valving assembly operates the annular valving assembly from the closed position to the open position;

operating the central valving assembly from the closed position to a reopen position; and producing hydrocarbons from at least one of the first and second zones into the wellbore.

* * * * *